US012066036B2

(12) United States Patent
Hayashi et al.

(10) Patent No.: US 12,066,036 B2
(45) Date of Patent: Aug. 20, 2024

(54) COMPRESSOR SYSTEM

(71) Applicant: MITSUBISHI HEAVY INDUSTRIES COMPRESSOR CORPORATION, Tokyo (JP)

(72) Inventors: Masahiro Hayashi, Hiroshima (JP); Tsukasa Tadomi, Hiroshima (JP); Masahiro Amano, Hiroshima (JP); Ryoji Ogasawara, Hiroshima (JP); Koichi Mizushita, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 18/160,497

(22) Filed: Jan. 27, 2023

(65) Prior Publication Data

US 2023/0243369 A1 Aug. 3, 2023

(30) Foreign Application Priority Data

Feb. 1, 2022 (JP) ..... 2022-013913

(51) Int. Cl.
*F04D 29/70* (2006.01)
*F04D 27/00* (2006.01)

(52) U.S. Cl.
CPC ..... *F04D 29/705* (2013.01); *F04D 27/001* (2013.01)

(58) Field of Classification Search
CPC .... F04D 29/705; F04D 27/001; F04D 27/007; F02C 7/00; F02C 7/30; F25B 13/00
See application file for complete search history.

(56) References Cited

U.S. PATENT DOCUMENTS

| | | | | |
|---|---|---|---|---|
| 11,643,946 | B2 * | 5/2023 | Saenz | B08B 3/10 134/22.18 |
| 2005/0096832 | A1 * | 5/2005 | Takada | F01D 25/002 701/100 |
| 2008/0173330 | A1 * | 7/2008 | Wagner | B08B 3/00 134/113 |
| 2014/0174474 | A1 | 6/2014 | Ekanayake et al. | |
| 2014/0229121 | A1 | 8/2014 | Greco et al. | |
| 2017/0211594 | A1 * | 7/2017 | Konno | E21C 50/00 |
| 2018/0283404 | A1 * | 10/2018 | Van de Cotte | F04D 29/701 |
| 2020/0173358 | A1 * | 6/2020 | Mezheritsky | B05B 1/202 |

FOREIGN PATENT DOCUMENTS

| | | | | |
|---|---|---|---|---|
| JP | 2011111990 A | * | 6/2011 | F04D 17/122 |
| JP | 2014-534370 A | | 12/2014 | |
| JP | 2015-021500 A | | 2/2015 | |

* cited by examiner

*Primary Examiner* — David E Sosnowski
*Assistant Examiner* — Jackson N Gillenwaters
(74) *Attorney, Agent, or Firm* — Osha Bergman Watanabe & Burton LLP

(57) ABSTRACT

A compressor system includes a compressor and a supply control unit that controls a state of supply of water and a state of supply of oil. The supply control unit includes a rate-of-change acquisition unit that acquires a rate of change in efficiency of the compressor, a supply amount acquisition unit that acquires the amount of supply of the oil, an operating cost acquisition unit that acquires an operation cost from the rate of change, an oil cost acquisition unit that acquires an oil cost from the amount of supply of the oil, and a cost relationship acquisition unit that acquires a plurality of provisional relationship values that are the relationship between the operating cost and the oil cost under each of the plurality of provisional cleaning conditions.

10 Claims, 8 Drawing Sheets

COMPRESSOR SYSTEM

BACKGROUND OF THE INVENTION

Field of the Invention

The present disclosure relates to a compressor system.

Priority is claimed on Japanese Patent Application No. 2022-13913, filed Feb. 1, 2022, the content of which is incorporated herein by reference.

Description of Related Art

A compressor is known as a device for compressing gas to produce high pressure gas. The compressor includes a rotor that rotates around an axis, an impeller provided on an outer peripheral surface of the rotor, and a casing that forms a flow path by covering the rotor and the impeller from the outer peripheral side. As the impeller rotates together with the rotor, gas flowing through the flow path is compressed. The compressed gas has a higher temperature and pressure than before compression.

Here, for example, when a gas containing an organic substance such as ethylene is circulated in the compressor, as the gas temperature increases, compounds contained in the gas may be polymerized inside the compressor to form a polymer called fouling. When such fouling adheres to a wall surface forming the flow path or the impeller, the efficiency of the compressor may be lowered. Also, when the fouling adheres to the impeller, it may lead to vibration due to imbalance of the rotor.

Therefore, for example, in the system described in Patent Document 1, data related to an operation of the compressor is collected, and the polytropic efficiency of the compressor is calculated on the basis of the collected data. On the basis of the polytropic efficiency, the degree of fouling formation in the compressor is specified, and cleaning with oil or water is carried out.

Patent Document

[Patent Document 1] Japanese Unexamined Patent Application, First Publication No. 2014-534370

SUMMARY OF THE INVENTION

However, as a countermeasure against this fouling, there are a method of continuously supplying water into the compressor to lower the temperature inside the compressor and to suppress occurrence of the fouling itself, and a method of regularly supplying oil into the compressor to remove the formed fouling. In cleaning using oil, as the amount of fouling formed in the compressor increases, a cleaning time which is the time during which oil is continuously supplied and a cleaning cycle time which is the cycle time of supplying oil increase. Since the oil used for cleaning is very expensive, an increase in the cleaning time and the cleaning cycle time leads to an increase in cleaning costs. On the other hand, the amount of fouling formed in the compressor varies greatly according to a plant in which the compressor is used and an operating period in which the compressor has been used, and thus the cleaning time and the cleaning cycle cannot be uniformly set. Furthermore, a high level of skill is required to set an optimal cleaning time and cleaning cycle for the compressor. Therefore, there is a problem that a setting operator uses an excessive amount of oil, resulting in an increase in cleaning costs.

The present disclosure provides a compressor system capable of easily obtaining an optimal cleaning time and cleaning cycle when the inside of the compressor is cleaned with oil.

A compressor system according to the present disclosure includes a compressor configured to compress gas supplied to a flow path formed therein, a water supply unit configured to supply water to the flow path inside the compressor in operation, an oil supply unit configured to supply oil to the flow path inside the compressor to which the water is supplied, a supply control unit configured to control a state of supply of the water to the compressor in the water supply unit and a state of supply of the oil to the compressor in the oil supply unit, and an oil information acquisition unit configured to acquire information on a status of supply of the oil supplied from the oil supply unit to the compressor, wherein the supply control unit includes a cleaning instruction unit that sends an instruction to the water supply unit to supply the water to the compressor and sends an instruction to the oil supply unit to supply the oil to the compressor under cleaning conditions having a set cleaning time and a cleaning cycle time, a provisional cleaning instruction unit that sends an instruction to the oil supply unit to supply the oil to the compressor under a plurality of provisional cleaning conditions having different predetermined cleaning times and cleaning cycle times, a rate-of-change acquisition unit that acquires a rate of change in efficiency of the compressor from information on a status of operation of the compressor, a supply amount acquisition unit that acquires the amount of supply of the oil from the information on the status of supply of the oil acquired by the oil information acquisition unit, an operation cost acquisition unit that acquires an operation cost in the cleaning cycle time from the rate of change acquired by the rate-of-change acquisition unit, an oil cost acquisition unit that acquires an oil cost for the cleaning time from the amount of supply of the oil acquired by the supply amount acquisition unit, and a cost relationship acquisition unit that acquires a plurality of provisional relationship values which is a relationship between the operation cost and the oil cost under each of the plurality of provisional cleaning conditions from the operation cost acquired by the operation cost acquisition unit and the oil cost acquired by the oil cost acquisition unit.

According to the compressor system of the present disclosure, it is possible to easily obtain an optimal cleaning time and cleaning cycle time when the inside of the compressor is cleaned with oil.

DETAILED DESCRIPTION OF THE INVENTION

Hereinafter, embodiments for implementing a compressor system 1 according to the present disclosure will be described with reference to the accompanying drawings. However, the present disclosure is not limited to only the embodiments.

First Embodiment (Configuration of Compressor System)

Figure 1:
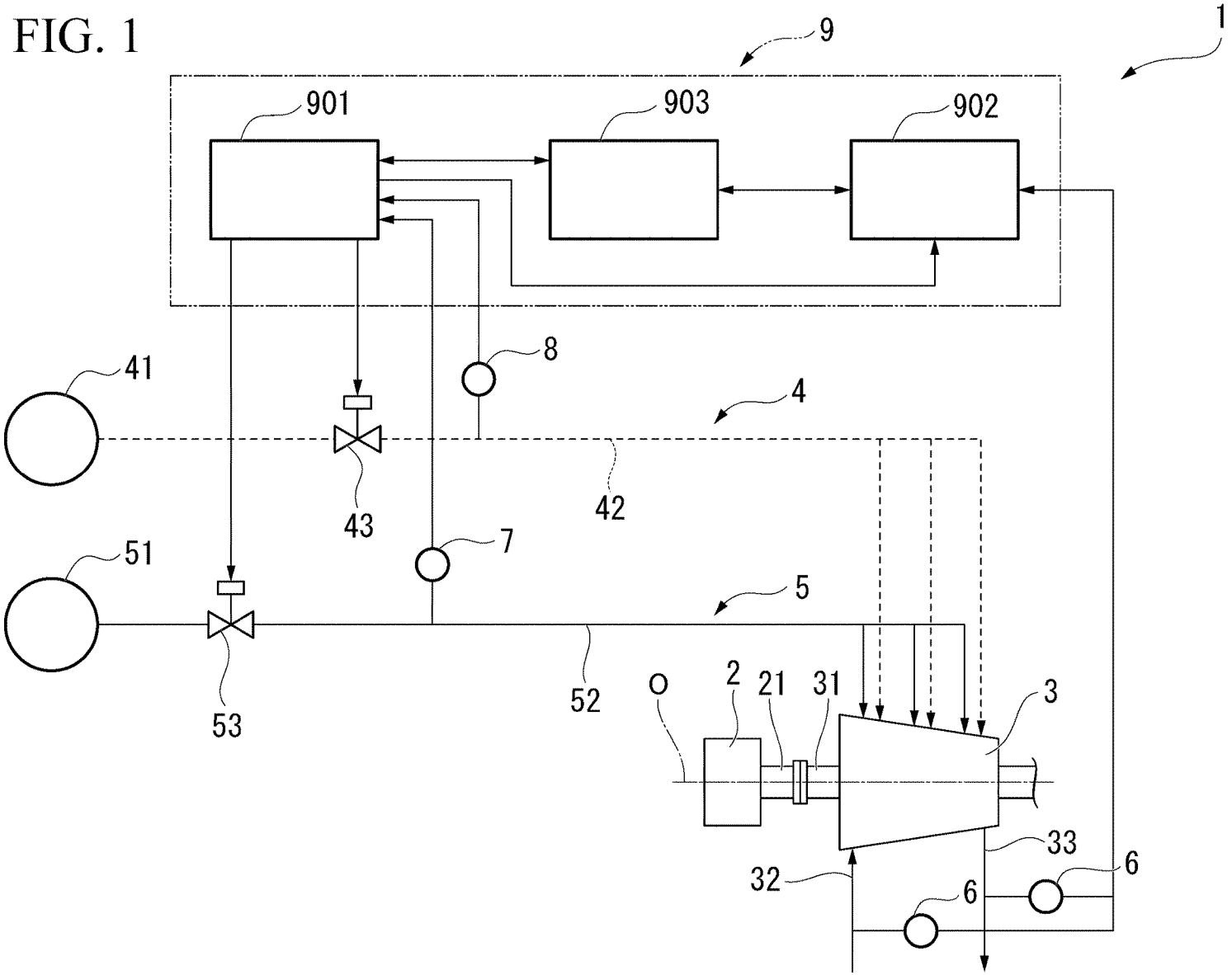
FIG. 1 is a schematic diagram showing a schematic configuration of a compressor system according to an embodiment of the present disclosure.

As shown in FIG. 1, the compressor system 1 causes a compressor 3 to be operated at high speed by one driving machine 2. The compressor system 1 is used, for example, in a plant that generates a gas containing ethylene, such as a petrochemical plant. The compressor system 1 is configured to be capable of cleaning the inside of the compressor 3 by supplying oil which is cleaning oil, and water which is cleaning water (cooling water) to the inside of the compressor 3 in operation. The compressor system 1 of the present embodiment includes the driving machine 2, the compressor 3, a water supply unit 4, an oil supply unit 5, a compressor information acquisition unit 6, an oil information acquisition unit 7, and a cooling water information acquisition unit 8, and a supply control unit 9.

The driving machine 2 is rotationally driven so as to generate power for driving the compressor 3. The driving machine 2 has a driving shaft 21 that rotates about the axis 0. The driving machine 2 of the present embodiment is a variable speed motor that drives the driving shaft 21 at a constant speed. For the driving machine 2, it is sufficient that it can generate power for driving the compressor 3, and a steam turbine or the like can be adopted in addition to the motor.

The compressor 3 uses supplied gas as a working fluid. The compressor 3 of the present embodiment is a cracked gas compressor that compresses, as the working fluid, hydrocarbon gas containing organic chemical substances such as ethylene and propylene produced by cracking hydrocarbons. The compressor 3 of the present embodiment is a single-shaft multi-stage centrifugal compressor that compresses a working fluid using a plurality of (for example, three) impellers (not shown) disposed inside a casing (not shown). The compressor 3 has a rotary shaft 31 that rotates about the axis 0. In the compressor 3, the working fluid is supplied from a supply line 32 connected to a suction port (not shown) for suction. In the compressor 3, a compressed fluid is sent to a discharge line 33 connected to a discharge port (not shown) for discharge. The compressed fluid that has been sent is supplied to other devices outside the compressor 3. Further, in the compressor 3, the temperature inside the compressor 3 increases with continuous operation, the hydrocarbon gas is caused to be polymerized, and inside the compressor 3, a polymer called fouling adheres to a wall surface forming a flow path (a flow path in the casing or a flow path in the impeller) through which hydrocarbon gas flows.

The water supply unit 4 supplies water for cooling to the flow path inside the compressor 3 in operation. The water supply unit 4 supplies water to the middle of the flow path of the compressor 3 (for example, the flow path in the casing connected to an outlet of the impeller), thereby lowering the temperature inside the compressor 3. Thus, in the compressor 3, occurrence of the fouling in operation is suppressed. That is, the water supply unit 4 constitutes a water injection system. The water supply unit 4 of the present embodiment has a cooling water supply source 41, a cooling water supply line 42, and a cooling water supply adjustment valve 43.

The cooling water supply source 41 is a device that pumps and supplies water using a pump or the like. The cooling water supply source 41 is, for example, a tank in which water is stored, or a device that circulates and supplies water used for various cooling of the compressor 3. The cooling water supply line 42 connects the cooling water supply source 41 to the compressor 3. The cooling water supply line 42 of the present embodiment branches into a plurality (three in the present embodiment) of lines on the downstream side close to the compressor 3. Thus, the water flowing through the cooling water supply line 42 is supplied to each stage of the compressor 3 (each of positions at which the impellers are disposed). The cooling water supply adjustment valve 43 is disposed on the cooling water supply line 42. The cooling water supply adjustment valve 43 is a valve capable of adjusting a flow rate of the water flowing through the cooling water supply line 42. The cooling water supply adjustment valve 43 in the present embodiment is an on/off valve that can switch between a fully open state that allows the water flowing through the cooling water supply line 42 to flow toward the compressor 3 and a fully closed state that prevents the water from flowing.

In the present embodiment, only one cooling water supply adjustment valve 43 is provided, but the present disclosure is not limited thereto. A plurality of cooling water supply adjustment valves 43 may be disposed on the cooling water supply line 42. Therefore, the cooling water supply adjustment valve 43 may be disposed at each of downstream portions of the branching cooling water supply line 42 to adjust the amount of water supplied to each stage of the compressor 3. Further, the cooling water supply adjustment valve 43 is not limited to the on/off valve, and may be a flow rate adjustment valve capable of adjusting a flow rate or a pressure adjustment valve capable of adjusting a supply pressure. Further, the cooling water supply adjustment valve 43 is not limited to being disposed on the cooling water supply line 42, and other valves may be disposed thereon. For example, a shut-off valve that stops supply of the water to the compressor 3 in an emergency may be disposed on the cooling water supply line 42.

The oil supply unit 5 supplies cleaning oil to the flow path inside the compressor 3 in operation to which water is supplied. As the cleaning oil, it is preferable to use a heavy oil with low volatility, which easily dissolves the polymer, and a large amount of aromatic components (aromatic components). Such oils are known to be very expensive. Specifically, the oil is preferably hydrogenated gasoline or C9+ aromatic fraction which is cracked naphtha oil. The oil supply unit 5 supplies oil to the middle of the flow path in the compressor 3 (for example, the flow path in the casing connected to the outlet of the impeller), thereby separating and washing away the fouling adhering to the inside of the compressor 3. As a result, in the compressor 3, the fouling adhering to the inside of the compressor 3 is removed while the compressor 3 is in operation. In other words, the oil supply unit 5 constitutes an oil injection system. The oil supply unit 5 of the present embodiment includes an oil supply source 51, an oil supply line 52 and an oil supply adjustment valve 53.

The oil supply source 51 is a device that pumps and supplies oil using a pump or the like. The oil supply source 51 is, for example, a tank in which oil is stored, or a device that supplies oil produced by another device outside the compressor 3. The oil supply line 52 connects the oil supply source 51 to the compressor 3. The oil supply line 52 of the present embodiment branches into a plurality (three in the present embodiment) of lines on the downstream side close to the compressor 3. The oil supply line 52 is disposed in parallel with the cooling water supply line 42. That is, the oil supply line 52 is connected to the compressor 3 at a position very close to a position at which the cooling water supply line 42 is connected. Thus, the oil that has flowed through the oil supply line 52 is supplied to each stage (each of the positions at which the impellers are disposed) of the compressor 3 at a position close to a position at which water is supplied. The oil supply adjustment valve 53 is disposed on the oil supply line 52. The oil supply adjustment valve 53 is a valve capable of adjusting a flow rate of oil flowing through the oil supply line 52. The oil supply adjustment valve 53 in the present embodiment is an on/off valve that can switch between a fully open state that allows the oil flowing through the oil supply line 52 to flow toward the compressor 3 and a fully closed state that prevents the oil from flowing.

Although only one oil supply adjustment valve 53 is provided in the present embodiment, the present disclosure is not limited to such a configuration. A plurality of oil supply adjustment valves 53 may be disposed on the oil supply line 52. Therefore, the oil supply adjustment valve 53 may be disposed at each of downstream portions of the branching oil supply lines 52 to adjust the amount of oil supplied to each stage of the compressor 3. Further, the oil supply adjustment valve 53 is not limited to the on/off valve, and may be a flow rate adjustment valve capable of adjusting the flow rate or a pressure adjustment valve capable of adjusting the supply pressure. Further, the oil supply adjustment valve 53 is not limited to being disposed on the oil supply line 52, and other valves may be disposed thereon. For example, a shutoff valve that stops supply of the oil to the compressor 3 in an emergency may be disposed on the oil supply line 52.

The compressor information acquisition unit 6 acquires information on a status of operation of the compressor 3. Here, the information on the status of operation of the compressor 3 is, for example, the flow rate, the temperature, and the pressure of the compressed fluid compressed by the compressor 3. The compressor information acquisition unit 6 of the present embodiment is disposed in the discharge line 33 and the supply line 32. The compressor information acquisition unit 6 has a plurality of sensors (not shown) capable of measuring the flow rate, the temperature, and the pressure. In other words, the compressor information acquisition unit 6 acquires information on the status of operation of the compressor 3 in operation in real time. The compressor information acquisition unit 6 sends the acquired information on the flow rate, the temperature, and the pressure of the compressed fluid to the supply control unit 9 as information on the status of operation of the compressor 3.

The oil information acquisition unit 7 acquires information on the status of supply of the oil supplied from the oil supply unit 5 to the compressor 3. Here, the information on the status of supply of the oil is, for example, the flow rate, temperature, and pressure of the oil supplied to the compressor 3. The oil information acquisition unit 7 of the present embodiment is disposed in the oil supply line 52. The oil information acquisition unit 7 has a plurality of sensors (not shown) capable of measuring the flow rate, the temperature, and the pressure. The oil information acquisition unit 7 sends the acquired information on the flow rate, the temperature, and the pressure of the oil to the supply control unit 9 as the information on the status of supply of the oil.

The cooling water information acquisition unit 8 acquires information on a status of supply of the water supplied from the water supply unit 4 to the compressor 3. Here, the information on the status of supply of the water is, for example, the flow rate, the temperature, and the pressure of the water supplied to the compressor 3. The cooling water information acquisition unit 8 of the present embodiment is disposed in the cooling water supply line 42. The cooling water information acquisition unit 8 has a plurality of sensors (not shown) capable of measuring the flow rate, the temperature, and the pressure. The cooling water information acquisition unit 8 sends the acquired information on the flow rate, the temperature, and the pressure of the water to the supply control unit 9 as the information on the status of supply.

(Configuration of Supply Control Unit)

The supply control unit 9 controls the state of supply of the water to the compressor 3 by the water supply unit 4 and the state of supply of the oil to the compressor 3 by the oil supply unit 5. The supply control unit 9 controls the water supply unit 4 and the oil supply unit 5 according to an operation condition of the compressor 3. The supply control unit 9 also controls the compressor 3. The supply control unit 9 of the present embodiment has an injection system control unit 901, a compressor operation data monitoring unit 902 and a remote monitoring unit 903.

The injection system control unit 901 controls the water supply unit 4 and the oil supply unit 5. Specifically, the injection system control unit 901 can adjust a degree of opening of the cooling water supply adjustment valve 43 according to the status of supply of the water flowing through the cooling water supply line 42. Furthermore, the injection system control unit 901 can adjust a degree of opening of the oil supply adjustment valve 53 according to the status of supply of the oil flowing through the oil supply line 52. The injection system control unit 901 sends the acquired information on the status of supply of the water and information on the status of supply of the oil to the remote monitoring unit 903.

The compressor operation data monitoring unit 902 controls the compressor 3. Specifically, the compressor operation data monitoring unit 902 acquires the status of operation of the compressor 3 and controls the compressor 3 according to the operation status. The compressor operation data monitoring unit 902 sends the acquired information on the status of operation of the compressor 3 to the injection system control unit 901 and the remote monitoring unit 903.

The remote monitoring unit 903 can monitor the injection system control unit 901 and the compressor operation data monitoring unit 902 from a remote location away from the driving machine 2, the compressor 3, the water supply unit 4, and the oil supply unit 5. Specifically, the remote monitoring unit 903 can acquire the information on the status of supply of the water and the information on the status of supply of the oil sent from the injection system control unit 901, and the information on the status of operation of the compressor 3 input from the compressor operation data monitoring unit 902 by displaying the information. Also, the remote monitoring unit 903 can control the water supply unit 4, the oil supply unit 5 and the compressor 3 by sending an instruction to the injection system control unit 901 and the compressor operation data monitoring unit 902.

Figure 2:
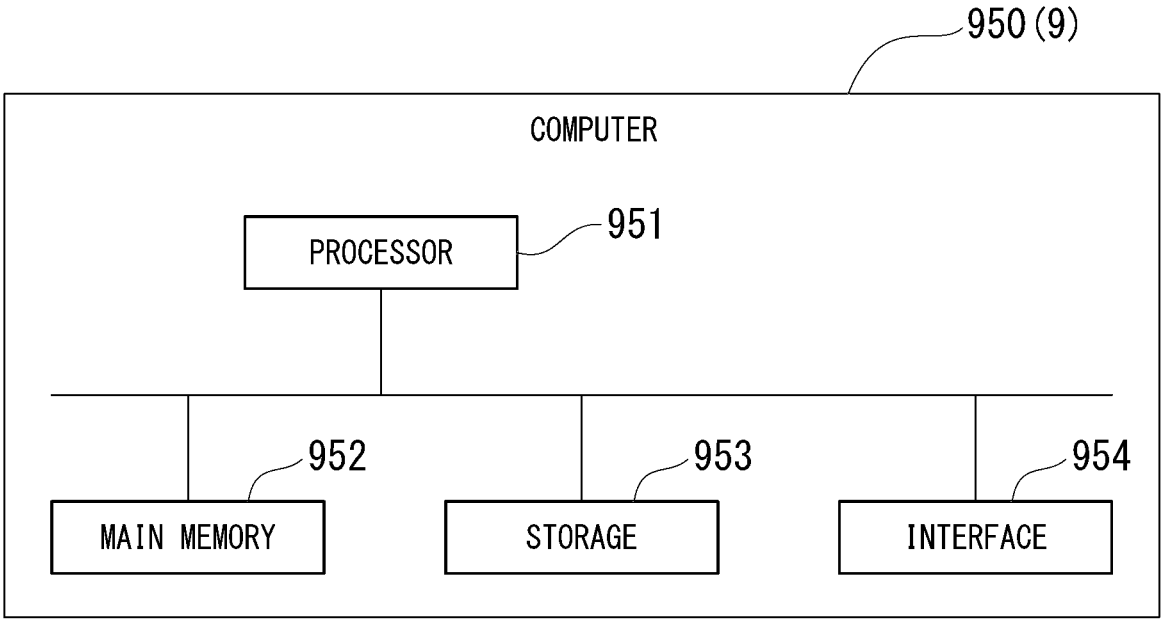
FIG. 2 is a diagram showing an example of a hardware configuration of a remote monitoring unit, an injection system control unit, and a compressor operation data monitoring unit according to the embodiment.

Also, each of the injection system control unit 901, the compressor operation data monitoring unit 902, and the remote monitoring unit 903 has a computer 950. As shown in FIG. 2, the computer 950 includes a processor 951, a main memory 952, a storage 953, and an interface 954.

The operations of the injection system control unit 901, the compressor operation data monitoring unit 902, and the remote monitoring unit 903 are stored in the storage 953 in the form of programs. The processor 951 reads a program from the storage 953, develops it in the main memory 952, and executes the above process according to the program. In addition, the processor 951 secures a storage region corresponding to each of the storage units described above in the main memory 952 according to the program.

The program may be for realizing some of functions that the computer 950 exhibits. For example, the program may be one that exhibits a function due to combination with other programs already stored in the storage 953 or combination with other programs installed in other devices.

Also, the computer 950 may include a custom large-scale integrated circuit (LSI) such as a programmable logic device (PLD) in addition to or instead of the above configuration. Examples of the PLD include programmable array logic (PAL), generic array logic (GAL), a complex programmable logic device (CPLD), and field programmable gate array (FPGA). In this case, part or the whole of the functions implemented by the processor 951 may be implemented by the integrated circuit.

Examples of the storage 953 include a magnetic disk, a magneto-optical disk, a semiconductor memory, and the like. The storage 953 may be an internal medium directly connected to a bus of the computer 950, or an external medium connected to the computer 950 via the interface 954 or a communication line.

Also, when the program is delivered to the computer 950 via a communication line, the computer 950 receiving the program may load the program into the main memory 952 and execute the above process. In the above embodiment, the storage 953 is a non-transitory tangible storage medium.

Also, the program may be for realizing part of the functions described above. Furthermore, the program may be a so-called difference file (a difference program) that implements the above functions in combination with others program already stored in the storage 953.

Figure 3:
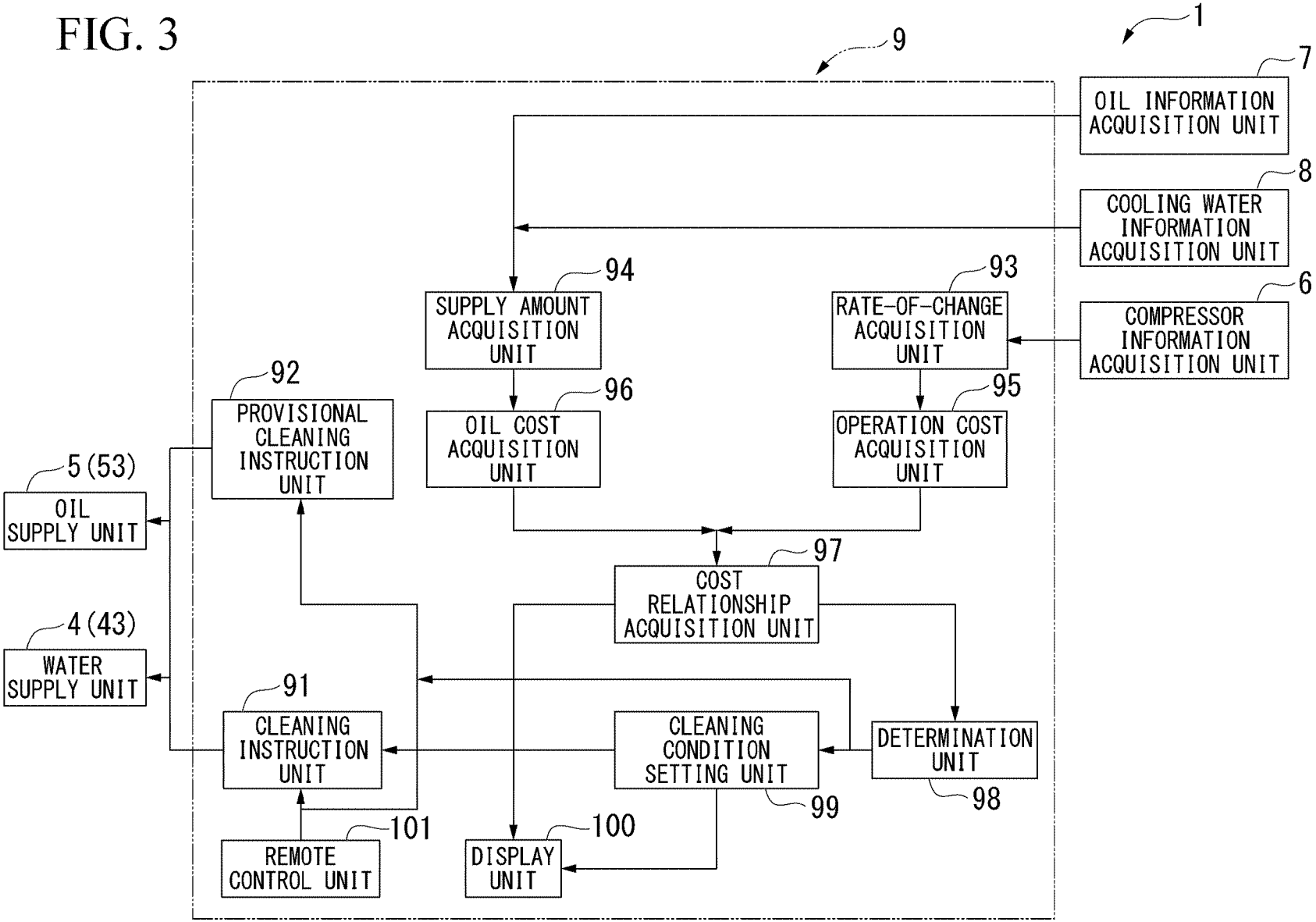
FIG. 3 is a block diagram showing a supply control unit according to a first embodiment.

As shown in FIG. 3, the supply control unit 9 of the present embodiment includes, as processing units, a cleaning instruction unit 91, a provisional cleaning instruction unit 92, a rate-of-change acquisition unit 93, a supply amount acquisition unit 94, an operation cost acquisition unit 95, an oil cost acquisition unit 96, a cost relationship acquisition unit 97, a determination unit 98, a cleaning condition setting unit 99, a display unit 100, and a remote control unit 101. The cleaning instruction unit 91, the provisional cleaning instruction unit 92, the rate-of-change acquisition unit 93, the supply amount acquisition unit 94, the operation cost acquisition unit 95, the oil cost acquisition unit 96, the cost relationship acquisition unit 97, the determination unit 98, the cleaning condition setting unit 99, the display unit 100, and the remote control unit 101 are operated by the computers 950 of the injection system control unit 901, the compressor operation data monitoring unit 902 and the remote monitoring unit 903.

The cleaning instruction unit 91 sends an instruction to the water supply unit 4 to supply water to the compressor 3 and sends an instruction to the oil supply unit 5 to supply oil to the compressor 3. Specifically, the cleaning instruction unit 91 sends an instruction to the water supply unit 4 to continuously clean the compressor 3 in operation. That is, the cleaning instruction unit 91 sends an instruction to change the degree of opening of the cooling water supply adjustment valve 43 so as to continuously supply water to the compressor 3. In the present embodiment, the cleaning instruction unit 91 sends an instruction to keep the cooling water supply adjustment valve 43 open at a constant opening degree during the operation of the compressor 3. Thus, the water supply unit 4 continues to always supply a constant amount of water to the compressor 3 in operation.

Figure 4:
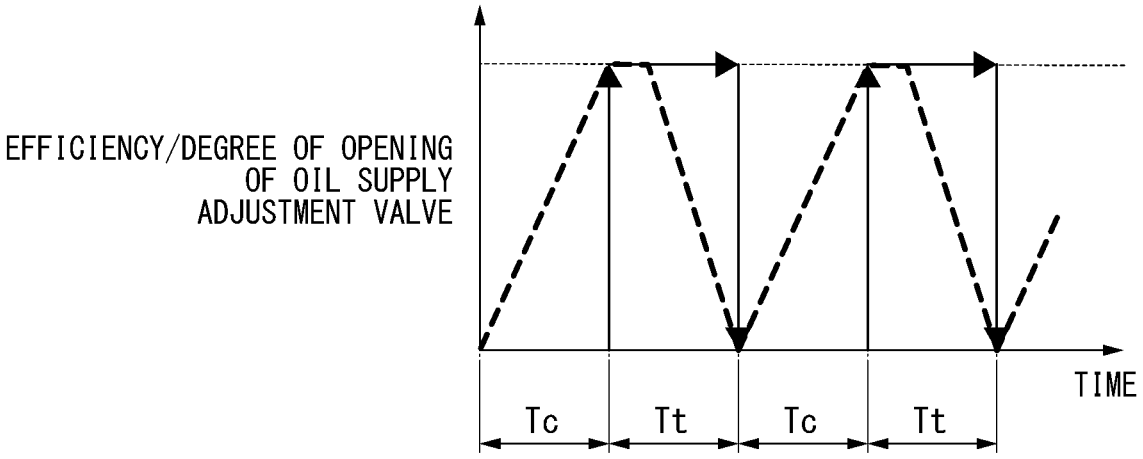
FIG. 4 is a diagram showing a relationship between a cleaning time, a cleaning cycle time, and operation efficiency of a compressor in the first embodiment.

Also, the cleaning instruction unit 91 sends an instruction to the oil supply unit 5 to perform cleaning under the cleaning conditions having set cleaning time Tt and cleaning cycle time Tc. In other words, the cleaning instruction unit 91 sends an instruction to change the degree of opening of the oil supply adjustment valve 53 so as to supply oil to the compressor 3 on the basis of the cleaning conditions. In the present embodiment, as shown in FIG. 4, during the operation of the compressor 3, the cleaning instruction unit 91 sends an instruction to the oil supply adjustment valve 53 to regularly repeat an open state and a closed state at the specified cleaning time Tt and cleaning cycle time Tc. Thus, the oil supply unit 5 intermittently supplies a constant amount of oil to the compressor 3 in operation. At that time, the cleaning instruction unit 91 sends an instruction to the oil supply adjustment valve 53 to keep it the open state for a predetermined period of time. The predetermined period of time during which the oil supply adjustment valve 53 is kept the open state is the cleaning time Tt. That is, during the cleaning time Tt, oil is supplied to the compressor 3 while the compressor 3 is in operation. Further, the cleaning instruction unit 91 sends an instruction to the oil supply adjustment valve 53 to keep it the closed state for a predetermined time after the oil supply adjustment valve 53 is in the open state for the cleaning time Tt. The predetermined period of time during which the oil supply adjustment valve 53 is kept the closed state is the cleaning cycle time Tc. That is, during the cleaning cycle time Tc, oil is not supplied to the compressor 3 even when the compressor 3 is in operation.

Figure 5:
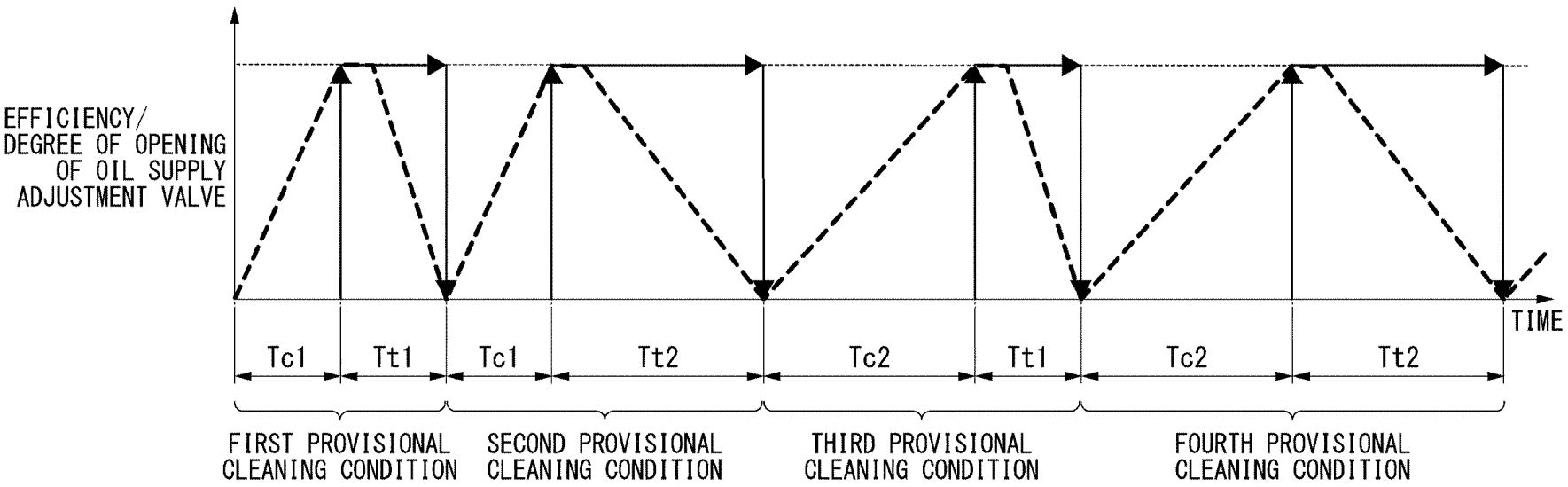
FIG. 5 is a diagram showing an example of a cleaning time and a cleaning cycle time under a provisional cleaning condition.

As shown in FIG. 3, the provisional cleaning instruction unit 92 sends an instruction to the oil supply unit 5 to supply oil to the compressor 3 under a plurality of provisional cleaning conditions having different predetermined cleaning times Tt and cleaning cycle times Tc. The provisional cleaning instruction unit 92 sends an instruction to the oil supply adjustment valve 53 to change the degree of opening before the cleaning instruction unit 91 sends an instruction to the oil supply adjustment valve 53. In other words, the provisional cleaning instruction unit 92 sends an instruction regarding the conditions for supplying oil to the compressor 3 to the oil supply unit 5 before the oil supply unit 5 regularly supplies the oil to the compressor 3. The plurality of provisional cleaning conditions are determined in advance before the compressor 3 starts the operation. In each of the provisional cleaning conditions, a plurality of different combinations of the cleaning times Tt and the cleaning cycle times Tc are determined. For example, in the present embodiment, as shown in FIG. 5, an instruction is sent to the oil supply adjustment valve 53 to change the degree of opening under the four provisional cleaning conditions by combining a first cleaning time Tt1 and a second cleaning time Tt2 with a first cleaning cycle time Tc1 and a second cleaning cycle time Tc2. The first cleaning time Tt1 is, for example, 30 minutes. The second cleaning time Tt2 is, for example, 60 minutes which is twice the first cleaning time Tt1. Also, the first cleaning cycle time Tel is, for example, one week. The second cleaning cycle time Tc2 is two weeks which is twice the first cleaning cycle time Tc1. Therefore, a first provisional cleaning condition has the first cleaning time Tt1 and the first cleaning cycle time Tc1. A second provisional cleaning condition has the second cleaning time Tt2 and the first cleaning cycle time Tc1. A third provisional cleaning condition has the first cleaning time Tt1 and the second cleaning cycle time Tc2. A fourth provisional cleaning condition has the second cleaning time Tt2 and the second cleaning cycle time Tc2.

The combinations of the cleaning time Tt and the cleaning cycle time Tc under the provisional cleaning condition are not limited to the above four. The provisional cleaning conditions may be appropriately set according to the compressor 3, and may be four or more conditions or four or less conditions.

Further, as shown in FIG. 3, the provisional cleaning instruction unit 92 of the present embodiment is configured to be capable of inputting information on a new provisional cleaning condition, which will be described later, from the determination unit 98. When the new provisional cleaning condition is input from the determination unit 98, an instruction is sent to the oil supply unit 5 (the oil supply adjustment valve 53) to supply oil to the compressor 3 under the new provisional cleaning condition.

The rate-of-change acquisition unit 93 acquires a rate of change of the efficiency of the compressor 3 from the information on the status of operation of the compressor 3. The information on the status of operation of the compressor 3 in operation is input from the compressor information acquisition unit 6 to the rate-of-change acquisition unit 93 of the present embodiment. The rate-of-change acquisition unit 93 calculates and acquires the efficiency of the compressor 3 in operation on the basis of the acquired information on the status of operation of the compressor 3. The rate-of-change acquisition unit 93 calculates and acquires the rate of change from the acquired information on the efficiency of the compressor 3. The rate of change of the efficiency is, for example, a slope in efficiency indicated by dashed lines in FIGS. 4 and 5.

The efficiency of the compressor 3 in operation decreases as an operation time of the compressor 3 increases and the fouling increases, and increases as the fouling decreases due to the supply of oil (refer to the dashed lines in FIGS. 4 and 5). In other words, the efficiency of the compressor 3 is an index that indicates the amount of fouling removed by oil.

The supply amount acquisition unit 94 acquires the amount of supply of the oil and the amount of supply the cooling water, as shown in FIG. 3. The information on the status of supply of the oil is input from the oil information acquisition unit 7 to the supply amount acquisition unit 94. The supply amount acquisition unit 94 calculates and acquires the amount of supply of the oil supplied to the compressor 3 on the basis of the information on the status of supply of the oil acquired by the oil information acquisition unit 7. The amount of supply of the oil is, for example, the amount of oil in the cleaning time Tt. Furthermore, the supply amount acquisition unit 94 receives the information on the status of supply of the water from the cooling water information acquisition unit 8. The supply amount acquisition unit 94 calculates and acquires the amount of supply of the cooling water supplied to the compressor 3 on the basis of the information on the status of supply of the water acquired by the cooling water information acquisition unit 8.

The operation cost acquisition unit 95 acquires the operation cost of the compressor 3 in operation. Information on the rate of change acquired by the rate-of-change acquisition unit 93 is input to the operation cost acquisition unit 95. The operation cost acquisition unit 95 calculates and acquires the operation cost for the cleaning time Tt and the cleaning cycle time Tc from the input rate of change. The operation cost is power cost when the compressor 3 is in operation, decreases as the efficiency increases, and increases as the efficiency decreases. Information on the status of operation of the compressor 3 is also input to the operation cost acquisition unit 95 from the rate-of-change acquisition unit 93.

The oil cost acquisition unit 96 acquires oil cost of the oil supplied to the compressor 3. The information on the amount of supply of the oil acquired by the supply amount acquisition unit 94 is input to the oil cost acquisition unit 96. The oil cost acquisition unit 96 calculates and acquires the oil cost for the cleaning time Tt from the input amount of supply of the oil. The oil cost is calculated, for example, on the basis of the amount of supply of the oil and a unit price of the oil used. In the present embodiment, the oil cost is acquired during the cleaning time Tt during which oil is supplied. The information on the amount of supply of the oil and the amount of supply of the cooling water is also input to the oil cost acquisition unit 96 from the supply amount acquisition unit 94.

The cost relationship acquisition unit 97 acquires a provisional relationship value that indicates the relationship between the operation cost and the oil cost from the operation cost acquired by the operation cost acquisition unit 95 and the oil cost acquired by the oil cost acquisition unit 96. The provisional relationship value is acquired for each of the plurality of provisional cleaning conditions. The provisional relationship value that is the relationship between the operation cost and the oil cost is a value that indicates the correlation, such as a rate of change in the operation cost due to a change in the oil cost, or a total value of the operation cost and the oil cost. In the present embodiment, the cost relationship acquisition unit 97 calculates the total value of the operation cost and the oil cost as the provisional relationship value. Further, the information on the status of operation and the information on the efficiency of the compressor 3 are also input to the cost relationship acquisition unit 97 from the operation cost acquisition unit 95. Furthermore, the information on the amount of supply of the oil and the amount of supply of the cooling water is also input from the oil cost acquisition unit 96 to the cost relationship acquisition unit 97.

The determination unit 98 determines whether or not there is a cleaning condition suitable for operating the compressor 3 from among the plurality of provisional cleaning conditions. Information on a plurality of provisional relationship values acquired by the cost relationship acquisition unit 97 is input to the determination unit 98. The determination unit 98 determines whether or not any one of the plurality of input provisional relationship values satisfies a predetermined optimal reference value when the compressor 3 is operated. The optimal reference value is a predetermined value that is estimated by the most suitable cleaning time Tt and cleaning cycle time Tc when the compressor 3 is operated. The optimal reference value is an upper limit value of at least one of the allowable operation cost and oil cost when the compressor 3 is operated. Specifically, the optimal reference value includes, for example, an upper limit allowable value of the rate of change in the operation cost associated with the change in oil cost, an upper limit allowable value of the total value of the operation cost and the oil cost, an upper limit allowable value of the operation cost, and an upper limit allowable value of the oil cost, as the plurality of cleaning conditions. In the determination unit 98 of the present embodiment, the optimal reference value is the upper limit allowable value of the total value of the operation cost and the oil cost.

When it is determined that any one of the plurality of provisional relationship values satisfies the optimal reference value, the determination unit 98 determines that the provisional relationship value is the cleaning condition suitable for operating the compressor 3. In other words, when any one of the provisional relationship values satisfies the optimal reference value, the determination unit 98 sends information of the provisional relationship value that satisfies the optimal reference value to the cleaning condition setting unit 99.

The determination unit 98 sends an instruction to the provisional cleaning instruction unit 92 to set a new provisional cleaning condition when all of the provisional relationship values do not satisfy the optimal reference value. The new provisional cleaning condition is a cleaning condition having a cleaning time Tt and a cleaning cycle time Tc different from those of the plurality of provisional cleaning conditions.

The provisional cleaning instruction unit 92 that has received the instruction sends an instruction to the oil supply adjustment valve 53 to supply oil under the new provisional cleaning condition. Then, the rate of change of efficiency under the new provisional cleaning condition is acquired by the rate-of-change acquisition unit 93. Then, the operation cost under the new provisional cleaning condition is acquired by the operation cost acquisition unit 95. Further, the amount of supply of the oil under the new provisional cleaning condition is acquired by the supply amount acquisition unit 94. The oil cost under the new provisional cleaning condition is acquired by the oil cost acquisition unit 96. As a result, a reacquisition relationship value that is the relationship between the operation cost and the oil cost under the new provisional cleaning condition is acquired in the cost relationship acquisition unit 97. The reacquisition relationship value is the same type of information as the provisional relationship value.

Then, the determination unit 98 determines whether or not the reacquisition relationship value input from the cost relationship acquisition unit 97 satisfies the optimal reference value. When it is determined that the reacquisition relationship value satisfies the optimal reference value, the determination unit 98 determines that the reacquisition relationship value is a cleaning condition suitable for operating the compressor 3. That is, the determination unit 98 sends information on the reacquisition relationship value to the cleaning condition setting unit 99.

The cleaning condition setting unit 99 acquires a regular cleaning condition on the basis of the cleaning time Tt and the cleaning cycle time Tc of the provisional relationship value sent from the determination unit 98. The regular cleaning condition is a condition for regularly supplying oil to the compressor 3 from the oil supply unit 5. Further, the cleaning condition setting unit 99 acquires the regular cleaning condition on the basis of the reacquisition relationship value when the determination unit 98 determines that the reacquisition relationship value satisfies the optimal reference value. The cleaning condition setting unit 99 may acquire values themselves of the cleaning time Tt and the cleaning cycle time Tc of the provisional relationship value or the reacquisition relationship value as the regular cleaning condition, and may acquire a new cleaning time Tt and cleaning cycle time Tc calculated on the basis of the cleaning time Tt and the cleaning cycle time Tc of the provisional relationship value or the reacquisition relationship value. When the regular cleaning conditions is calculated on the basis of the cleaning time Tt and the cleaning cycle time Tc of the provisional relationship value or the reacquisition relationship value, the information on the status of operation of the compressor 3, the information on the status of supply of the oil, the information on the status of supply of the water, the information on the oil cost, the information on the operation cost, and the like are input, and corrected values may be acquired on the basis of the input values.

The cleaning condition setting unit 99 sends an instruction to set the acquired regular cleaning conditions to the cleaning instruction unit 91. Furthermore, the cleaning condition setting unit 99 sends the acquired information on the regular cleaning conditions to the display unit 100. The cleaning instruction unit 91 that has received the instruction sends an instruction to the oil supply unit 5 to supply the oil under the regular cleaning condition. Thus, the oil supply unit 5 continues to regularly supply the oil to the compressor 3 under the regular cleaning condition until a new cleaning condition is set.

The display unit 100 displays the provisional relationship value acquired by the cost relationship acquisition unit 97. The display unit 100 of the present embodiment is, for example, a monitor on which an operator can visually recognize the cleaning time Tt and the cleaning cycle time Tc. The display unit 100 is disposed in the remote monitoring unit 903, for example. The display unit 100 also displays the regular cleaning condition by receiving the information on the regular cleaning condition from the cleaning condition setting unit 99. Furthermore, the display unit 100 can also display the information on the status of operation of the compressor 3, the information on the amount of supply of the oil, and the information on the amount of supply of the cooling water by receiving an input thereof from the cost relationship acquisition unit 97.

The remote control unit 101 can change the cleaning time Tt and the cleaning cycle time Tc by sending an instruction to the cleaning instruction unit 91 from a remote location. The remote control unit 101 of the present embodiment is, for example, the interface 954 that can be operated by an operator. The remote control unit 101 is disposed in the remote monitoring unit 903, for example. The remote control unit 101 can also change the provisional cleaning condition by sending an instruction to the provisional cleaning instruction unit 92 from a remote location.

Next, a flow of water injection and oil injection to the compressor 3 in operation will be described. In the compressor system 1, along with the operation of the compressor 3, the water supply unit 4 receives an instruction from the cleaning instruction unit 91 to supply water to the compressor 3. As a result, the cooling water supply adjustment valve 43 is opened to a predetermined constant degree, and water from the cooling water supply source 41 is supplied to each stage of the compressor 3 through the cooling water supply line 42. Thus, the water flows through the flow path inside the compressor 3 in operation. In this way, the water injection is continuously performed to the compressor 3 in operation. As a result, the inside of the compressor 3 is cooled, and polymerization of the hydrocarbon gas flowing through the flow path is suppressed. Thus, adhesion of the fouling to the wall surface of the flow path is suppressed.

Further, the information on the status of supply of the water supplied to the compressor 3 through the cooling water supply line 42 is acquired by the cooling water information acquisition unit 8. The acquired information on the status of supply of the water is sent to the supply amount acquisition unit 94 and is used for water supply.

Further, in the compressor system 1, the oil supply unit 5 receives an instruction from the provisional cleaning instruction unit 92 to supply the oil to the compressor 3 after the compressor 3 has been operated for a certain period of time since the start of operation. The provisional cleaning instruction unit 92 sends a plurality of predetermined provisional cleaning conditions to the oil supply unit 5. As a result, the oil supply adjustment valve 53 is opened to a predetermined constant degree, and the oil from the oil supply source 51 is supplied to each stage of the compressor 3 through the oil supply line 52. In this way, the intermittent oil injection is performed on the compressor 3 in operation. Thus, the oil flows through the flow path inside the compressor 3 in operation. Furthermore, since the plurality of provisional cleaning conditions are sent to the oil supply unit 5, as shown in FIG. 5, the supply of oil under the plurality of provisional cleaning conditions is completed at a stage before an instruction is received from the cleaning instruction unit 91.

The information on the status of supply of the oil supplied to the compressor 3 through the oil supply line 52 is acquired by the oil information acquisition unit 7. The acquired information on the status of supply of the oil is sent to the supply amount acquisition unit 94. Thus, the supply amount acquisition unit 94 calculates and acquires the amount of supply of the oil supplied to the compressor 3 under each of the provisional cleaning conditions (only the cleaning time Tt). The supply amount acquisition unit 94 sends the acquired information on the amount of supply of the oil under each of the provisional cleaning conditions to the oil cost acquisition unit 96.

The oil cost acquisition unit 96 calculates and acquires the oil cost of the oil supplied for the cleaning time Tt from the acquired information on the amount of supply of the oil on the basis of the unit price of the oil. That is, the oil cost under each of the provisional cleaning conditions (only the cleaning time Tt) is acquired. The oil cost acquisition unit 96 sends the acquired information on the oil cost and information on the amount of supply of the oil and the amount of supply of the cooling water to the cost relationship acquisition unit 97.

Further, in the compressor system 1, the information on the status of operation of the compressor 3 that is in operation is acquired by the compressor information acquisition unit 6. Efficiency information during an entire operation period of the compressor 3 including the cleaning time Tt and the cleaning cycle time Tc is acquired in the compressor information acquisition unit 6. The acquired information on the status of operation of the compressor 3 is sent to the rate-of-change acquisition unit 93. Thus, the rate-of-change acquisition unit 93 calculates and acquires a rate of change in the efficiency of the compressor 3 that is in operation. That is, the rate-of-change acquisition unit 93 acquires the rate of change in the efficiency during the entire operation period of the compressor 3 including the cleaning time Tt and the cleaning cycle time Tc. The rate-of-change acquisition unit 93 sends the acquired information on the rate of change in the efficiency and information on the status of operation of the compressor 3 to the operation cost acquisition unit 95.

The operation cost acquisition unit 95 calculates and acquires the operation cost for each of the cleaning time Tt and the cleaning cycle time Tc from the acquired information on the rate of change in the efficiency of the compressor 3. That is, the operation cost for each of the provisional cleaning conditions (both the cleaning time Tt and the cleaning cycle time Tc) is acquired. The operation cost acquisition unit 95 sends the acquired information on the operation cost, information on the status of operation of the compressor 3, and information on the efficiency to the cost relationship acquisition unit 97.

The cost relationship acquisition unit 97 acquires a provisional relationship value that is the relationship between the operation cost and the oil cost on the basis of the information on the operation cost sent from the operation cost acquisition unit 95 and the information on the oil cost sent from the oil cost acquisition unit 96. In the present embodiment, the cost relationship acquisition unit 97 acquires, for example, the total value of the operation cost and the oil cost as the provisional relationship value for each of the plurality of provisional cleaning conditions. The cost relationship acquisition unit 97 sends the acquired information on the provisional relationship value to the determination unit 98. In addition, the cost relationship acquisition unit 97 sends the acquired information on the provisional relationship value, information on the oil cost, information on the amount of supply of the oil and the amount of supply of the cooling water, information on the operation cost, information on the status of operation of the compressor 3, and information on the efficiency to the display unit 100.

The determination unit 98 determines whether or not any one of the plurality of provisional relationship values satisfies the optimal reference value on the basis of the input information of the provisional relationship values. Specifically, the determination unit 98 determines whether or not the total value of the operation cost and the oil cost corresponding to the provisional relationship value exceeds the upper allowable value. When it is determined that any one of the plurality of provisional relationship values satisfies the optimal reference value, the determination unit 98 sends the information on the provisional relationship value to the cleaning condition setting unit 99.

When it is determined that all of the plurality of provisional relationship values do not satisfy the optimal reference value, the determination unit 98 sends an instruction to the provisional cleaning instruction unit 92 to set a new provisional cleaning condition. The provisional cleaning instruction unit 92 that has received the instruction calculates and acquires a new provisional cleaning condition on the basis of the plurality of provisional cleaning conditions. The provisional cleaning instruction unit 92 sends an instruction to the oil supply adjustment valve 53 to supply the oil under the acquired new provisional cleaning condition. Then, the operation cost and the oil cost are acquired in the same way as when the oil had been supplied under the provisional cleaning conditions. As a result, the cost relationship acquisition unit 97 acquires a reacquisition relationship value that is the relationship between the operation cost and the oil cost under the new provisional cleaning condition. Then, the determination unit 98 performs determination again. Specifically, it is determined whether or not the reacquisition relationship value satisfies the optimal reference value. When it is determined that the reacquisition relationship value satisfies the optimal reference value, the determination unit 98 sends information on the reacquisition relationship value to the cleaning condition setting unit 99.

The cleaning condition setting unit 99 acquires the regular cleaning condition on the basis of the cleaning time Tt and the cleaning cycle time Tc of the provisional relationship value or the reacquisition relationship value sent from the determination unit 98. The cleaning condition setting unit 99 sends an instruction to the cleaning instruction unit 91 to set the acquired regular cleaning condition. The cleaning instruction unit 91 that has received the instruction sets the regular cleaning condition. Thus, after the oil is supplied under the provisional cleaning condition, the oil supply adjustment valve 53 is opened under the regular cleaning condition, and the oil is regularly supplied to the compressor 3. As a result, the oil injection is performed on the compressor 3 under the regular cleaning condition.

(Actions and Effects)

In the compressor system 1 configured as described above, the cost relationship acquisition unit 97 acquires the provisional relationship value that is the relationship between the operation cost and the oil cost under each of the plurality of provisional cleaning conditions having different predetermined cleaning times Tt and cleaning cycle times Tc. As a result, it is possible to grasp the relationship between the operation cost and the oil cost under a plurality of conditions in which the cleaning time Tt for supplying the oil and the cleaning cycle time Tc that is an interval until the next oil supply are changed. Therefore, it is possible to grasp how the relationship between the operation cost and the oil cost fluctuates due to the change in the cleaning time Tt and the cleaning cycle time Tc. Thus, it is possible to easily acquire the optimal cleaning time Tt and cleaning cycle time Tc for achieving the desired optimal conditions for the operation cost and the oil cost when the inside of the compressor 3 is cleaned with oil.

Further, when the determination unit 98 determines that any one of the plurality of provisional relationship values satisfies the optimal reference value, information on the provisional relationship value is set in the cleaning instruction unit 91 via the cleaning condition setting unit 99. Thus, the optimal cleaning time Tt and cleaning cycle time Tc when the inside of the compressor 3 is cleaned with oil can be automatically instructed to the oil supply unit 5. Therefore, it is possible to automatically perform the oil injection at the optimal cleaning time Tt and cleaning cycle time Tc without intervention of an operator.

Furthermore, even when all of the plurality of provisional relationship values do not satisfy the optimal reference value, the determination unit 98 sends an instruction to the provisional cleaning instruction unit 92 to set a new provisional cleaning condition having a cleaning time Tt and a cleaning cycle time Tc different from those in the plurality of provisional relationship values. Therefore, even when there is no optimal cleaning time Tt and cleaning cycle time Tc among the plurality of preset provisional cleaning conditions, the optimal cleaning time Tt and cleaning cycle time Tc can be automatically searched for and acquired. As a result, the optimal cleaning time Tt and cleaning cycle time Tc when the inside of the compressor 3 is cleaned with oil can be easily acquired with high accuracy.

Further, the provisional relationship value acquired by the cost relationship acquisition unit 97 is displayed on the display unit 100. Furthermore, in the present embodiment, the display unit 100 can display the regular cleaning condition, the information on the status of operation of the compressor 3, the information on the amount of supply of the oil, and the information on the amount of supply of the cooling water. Therefore, the operator can easily grasp such information and can confirm the validity thereof.

In addition, the cleaning time Tt and the cleaning cycle time Tc can be changed at a remote location with respect to the cleaning instruction unit 91 by the remote control unit 101. Furthermore, the remote control unit 101 of the present embodiment can change the provisional cleaning condition at a remote location with respect to the provisional cleaning instruction unit 92 as well. Therefore, a timing of supplying the oil by the oil supply unit 5 can be easily adjusted at a position distant from the oil supply unit 5 and the cleaning instruction unit 91.

Also, the optimal reference value used as a reference for determination by the determination unit 98 is an upper limit value of at least one of the allowable operation cost and oil cost when the compressor 3 is operated. In the present embodiment, an allowable upper limit value of the total value of the operation cost and the oil cost is set as the optimal reference value. Therefore, it is possible to keep total cost of the operation cost and the oil cost when the inside of the compressor 3 is cleaned with oil within an allowable range for the compressor system 1.

Also, the rate-of-change acquisition unit 93 acquires the rate of change in the efficiency on the basis of the information on the operation of the compressor 3 that is in operation acquired by the compressor information acquisition unit 6. Therefore, it is possible to acquire information for accurately grasping the state of the compressor 3 that is actually in operation. Thus, the operation cost when the inside of the compressor 3 is cleaned with oil can be acquired with high accuracy.

Second Embodiment

Next, a second embodiment of the compressor system according to the present disclosure will be described. In addition, in the second embodiment described below, the same reference numerals are given in the drawings to the configurations common to those in the above-described first embodiment, and a description thereof will be omitted.

(Configuration of Supply Control Unit)

Figure 6:
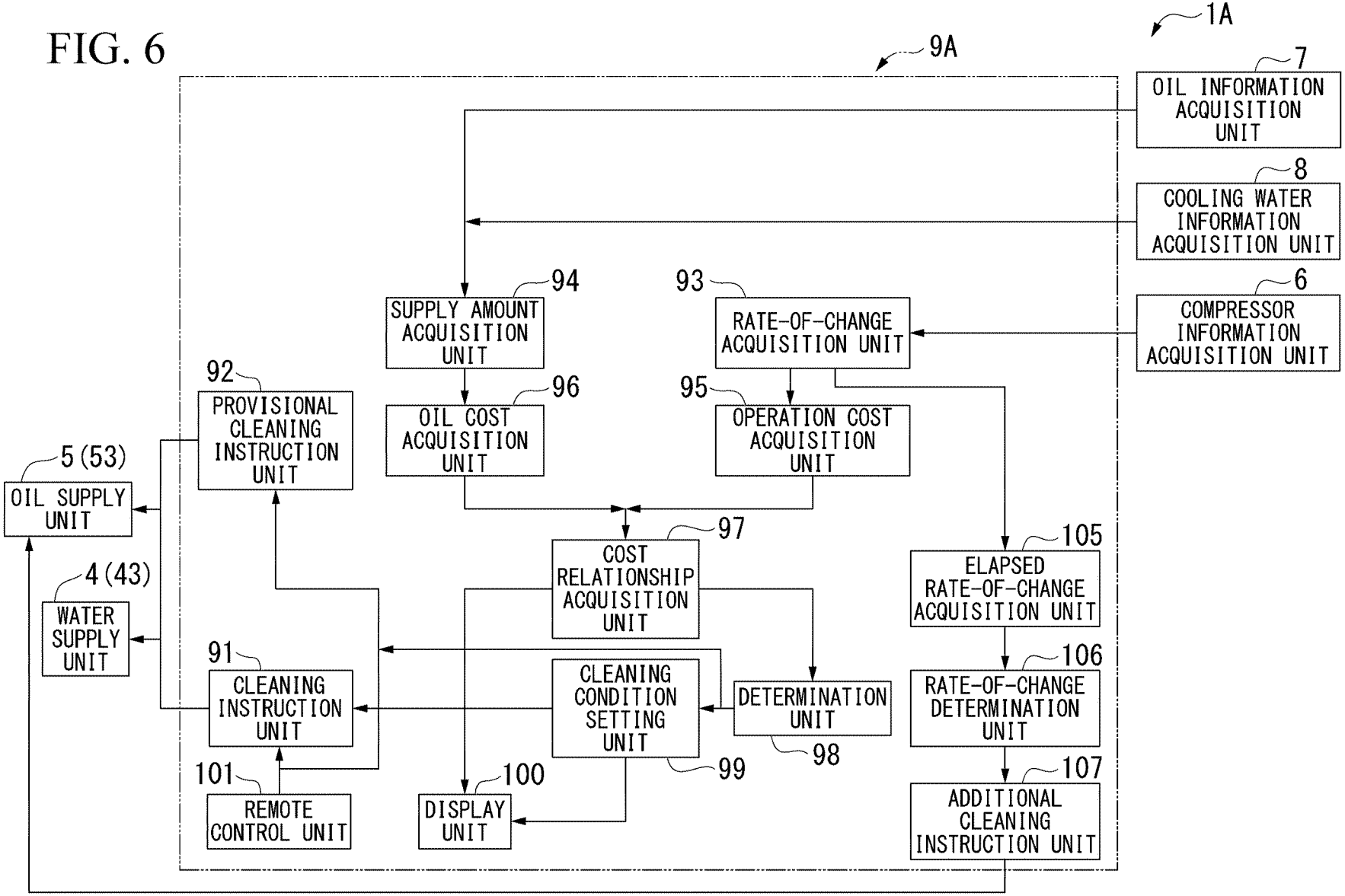
FIG. 6 is a block diagram showing a supply control unit according to a second embodiment.

As shown in FIG. 6, in a compressor system 1A of the second embodiment, a configuration of a supply control unit 9A is different. The supply control unit 9A of the second embodiment further includes an elapsed rate-of-change acquisition unit 105, a rate-of-change determination unit 106, and an additional cleaning instruction unit 107.

The elapsed rate-of-change acquisition unit 105 acquires an elapsed rate of change on the basis of the information on the status of operation of the compressor 3. The elapsed rate-of-change acquisition unit 105 of the present embodiment receives, from the compressor information acquisition unit 6, information on the status of operation of the compressor 3 that is in operation in the cleaning cycle time Tc. The elapsed rate-of-change acquisition unit 105 calculates and acquires the elapsed rate-of-change of the compressor 3 in operation on the basis of the information on the status of operation of the compressor 3 acquired by the compressor information acquisition unit 6. The elapsed rate of change is a rate of change in efficiency of the compressor 3 per predetermined period of time when no oil is being supplied.

The rate-of-change determination unit 106 determines whether or not the elapsed rate of change exceeds a predetermined reference rate of change. Information on the elapsed rate of change acquired by the elapsed rate-of-change acquisition unit 105 is input to the rate-of-change determination unit 106. The reference rate of change is a predetermined rate of change in efficiency per unit time on the basis of the amount of generation of the fouling allowable when the compressor 3 is operated. Specifically, the reference rate of change is an upper limit value of the rate of change in the efficiency per unit time when the amount of fouling that significantly reduces the efficiency is generated. When it is determined that the elapsed rate of change exceeds the reference rate of change, the rate-of-change determination unit 106 sends an instruction to the additional cleaning instruction unit 107 to start cleaning.

The additional cleaning instruction unit 107 receives the instruction from the rate-of-change determination unit 106 and sends an instruction to the oil supply unit 5 to supply the oil to the compressor 3. The additional cleaning instruction unit 107 sends an instruction to the oil supply adjustment valve 53 to change the degree of opening thereof so as to supply the oil to the compressor 3 for a short-term cleaning time Ta that is a cleaning time Tt shorter than the cleaning time Tt in the regular cleaning condition.

In the compressor system 1A of the second embodiment, while the oil injection is performed under the regular cleaning condition by the cleaning instruction unit 91, short-term oil injection is performed by the additional cleaning instruction unit 107.

Figure 7:
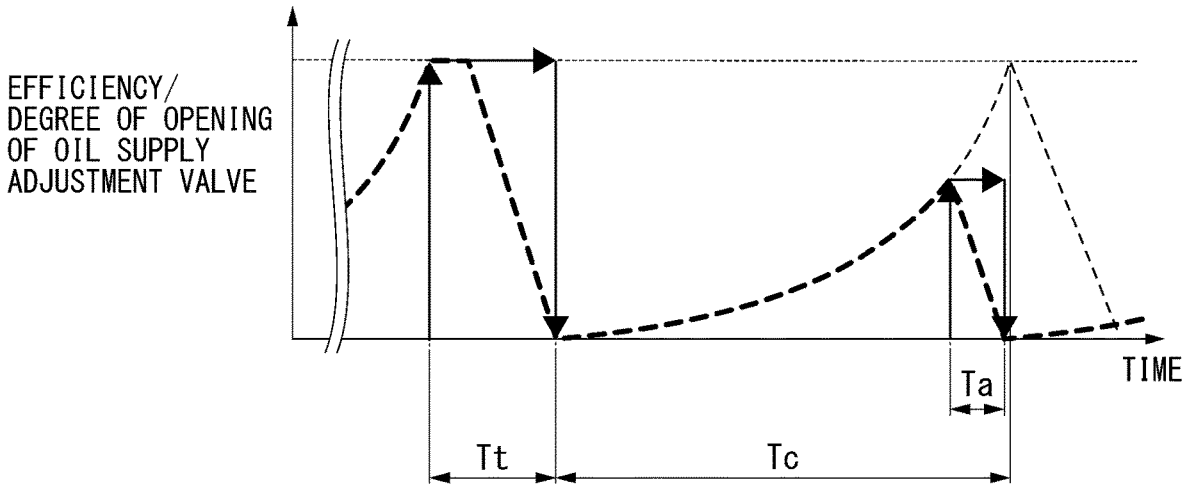
FIG. 7 is a diagram showing a relationship between a cleaning time, a cleaning cycle time, and operation efficiency of the compressor in the second embodiment.

Specifically, the elapsed rate-of-change acquisition unit 105 acquires the elapsed rate of change of the compressor 3 in operation from the information on the operation status of the compressor 3 that is in operation in the cleaning cycle time Tc acquired by the compressor information acquisition unit 6. The rate-of-change determination unit 106 determines whether or not the acquired elapsed rate of change exceeds the reference rate of change. When it is determined that the elapsed rate of change exceeds the reference rate of change, an instruction to start cleaning is sent to the additional cleaning instruction unit 107. Thus, as shown in FIG. 7, after the supply of oil under the regular cleaning conditions, the oil supply adjustment valve 53 is opened for the short-term cleaning time Ta, and the oil is supplied to the compressor 3 for a short time before the regular supply.

(Actions and Effects)

In the compressor system 1A configured as described above, when the rate-of-change determination unit 106 determines that the elapsed rate of change exceeds the reference rate of change, the additional cleaning instruction unit 107 issues a cleaning instruction separately from the cleaning instruction unit 91. In general, in a situation in which oil is not supplied to the compressor 3 during the cleaning cycle time Tc, as shown in FIG. 7, the efficiency of the compressor 3 that is actually in operation does not change linearly like a linear curve, as shown in FIGS. 4 and 5, and it may increase like a parabolic curve with an increasing slope over time, like a quadratic curve as shown in FIG. 7. When the efficiency of the compressor 3 changes in this way, it may suddenly deteriorate when a certain amount of time has passed after the oil supply end (from the start of the cleaning cycle time Tc). On the other hand, in the second embodiment, after the oil is supplied under the regular cleaning condition, the additional cleaning instruction unit 107 opens the oil supply adjustment valve 53 for the short-term cleaning time Ta, and the oil is supplied to the compressor 3 for a short time before the regular supply. As a result, the fouling can be removed at a stage at which the efficiency is remarkably lowered in a state in which the oil is not supplied according to the regular cleaning condition. Therefore, efficient fouling removal can be performed with a minimum amount of supply of the oil.

Third Embodiment

Next, a third embodiment of the compressor system according to the present disclosure will be described. In addition, in the third embodiment described below, the same reference numerals are given in the drawings for the configurations common to those in the first embodiment and the second embodiment, and a description thereof will be omitted.

(Configuration of Supply Control Unit)

Figure 8:
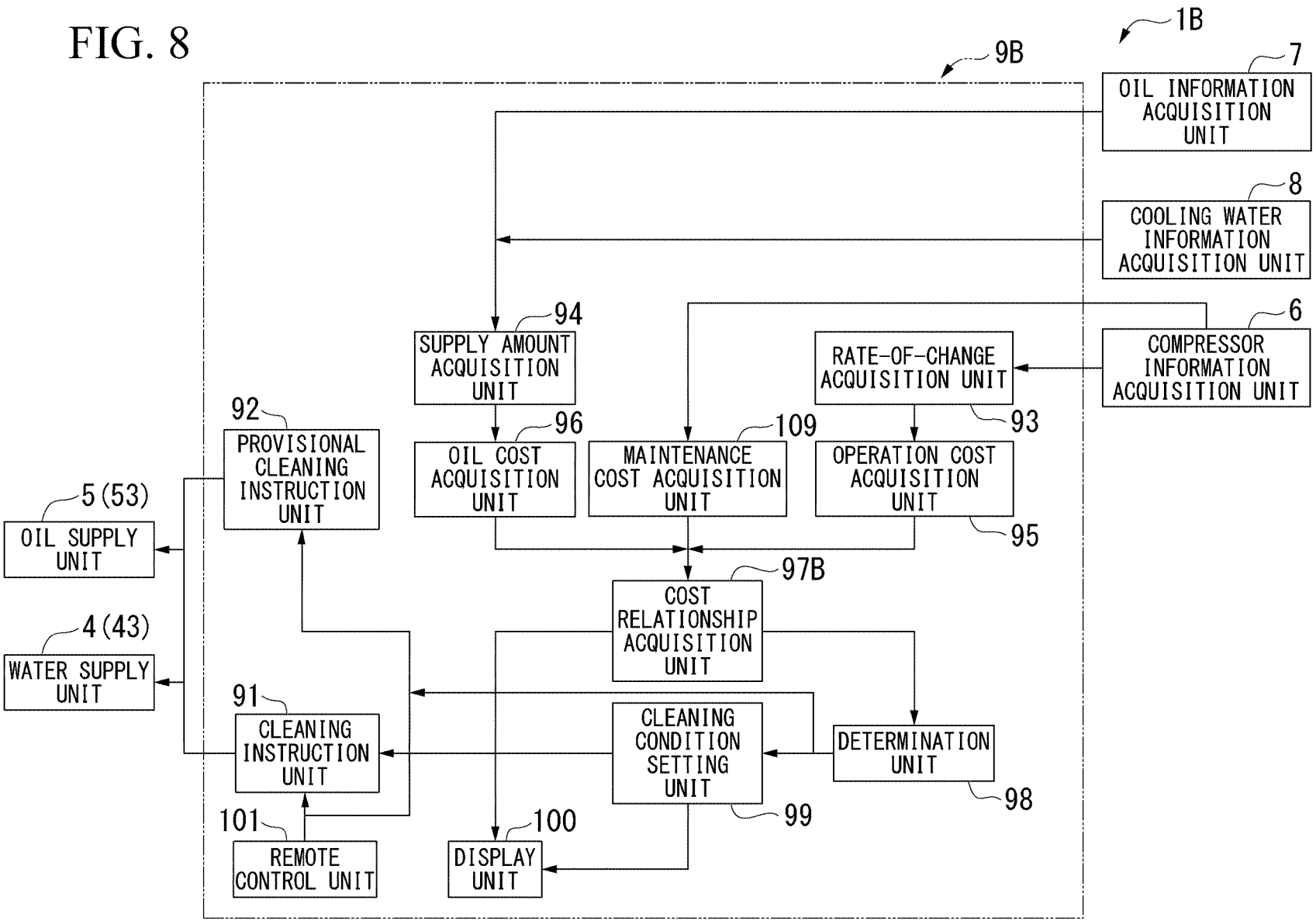
FIG. 8 is a block diagram showing a supply control unit according to a third embodiment.

As shown in FIG. 8, in a compressor system 1B of the third embodiment, a configuration of a supply control unit 9B is different. The supply control unit 9B of the third embodiment further includes a maintenance cost acquisition unit 109.

The maintenance cost acquisition unit 109 acquires a maintenance cost when maintenance on the compressor 3 is performed from the information on the status of operation of the compressor 3. The information on the status of operation of the compressor 3 in operation is input from the compressor information acquisition unit 6 to the maintenance cost acquisition unit 109 of the present embodiment. The maintenance cost acquisition unit 109 calculates the state of the compressor 3 on the basis of the information on the state of operation of the compressor 3, and calculates and acquires costs such as disassembly and assembly costs for maintenance of the compressor 3 and transport costs for replacement and repair parts.

The cost relationship acquisition unit 97B acquires the maintenance cost acquired by the maintenance cost acquisition unit 109 in addition to the operation cost and the oil cost. The cost relationship acquisition unit 97B acquires the relationship between the maintenance cost, the operation cost, and the oil cost as a provisional relationship value.

(Actions and Effects)

In the compressor system 1B configured as described above, the cost relationship acquisition unit 97B acquires the provisional relationship value that is a relationship including not only the operation cost and the oil cost but also the maintenance cost. As a result, the operation cost and the oil cost when the inside of the compressor 3 is cleaned with oil can be set to a desired optimal condition, taking into consideration the maintenance cost. Therefore, more optimal cleaning time Tt and cleaning cycle time Tc can be easily acquired.

Other Embodiments

As described above, the embodiments of the present disclosure have been described in detail with reference to the drawings, but the specific configuration is not limited to the embodiments, and design changes and the like within the scope of the present disclosure are also included.

When the supply of the oil is not automatically performed, the supply control units 9, 9A, and 9B may not include the determination unit 98 and the cleaning condition setting unit 99. Also in such a case, since the optimal cleaning condition can be acquired by the cost relationship acquisition unit 97, the operator can manually supply the oil to perform cleaning.

Each of the supply control units 9, 9A, and 9B may be one device. That is, the supply control units 9, 9A, and 9B do not have to include the injection system control unit 901, the compressor operation data monitoring unit 902, and the remote monitoring unit 903 as in the present embodiments. In this case, in each of the supply control units 9, 9A, and 9B, the cleaning instruction unit 91, the provisional cleaning instruction unit 92, the a rate-of-change acquisition unit 93, the supply amount acquisition unit 94, the operation cost acquisition unit 95, the oil cost acquisition unit 96, the cost relationship acquisition unit 97, the determination unit 98, and the cleaning condition setting unit 99 are performed by only one computer 950.

Further, although the rate-of-change acquisition unit 93 of the present embodiment calculates and acquires the rate of change in the efficiency of the compressor 3 in operation on the basis of the information on the status of operation of the compressor 3 acquired by the compressor information acquisition unit 6, the rate of change in the efficiency of the compressor 3 is not limited to that based on the acquired information on the status of operation of the compressor 3. That is, the rate of change in the efficiency of the compressor 3 may not be based on the information of the compressor 3 in operation. For example, the rate-of-change acquisition unit 93 may acquire the rate of change in the efficiency of the compressor 3 estimated on the basis of a compressor deterioration model acquired by modeling the efficiency of the compressor 3 over time. In this way, since the rate of change in the efficiency of the compressor 3 estimated on the basis of the compressor deterioration model is acquired, the rate of change in the efficiency of the compressor 3 can be acquired without providing a device for acquiring the information on the compressor 3 in operation, such as the compressor information acquisition unit 6. As a result, the cost of the compressor system 1 can be reduced.

Moreover, the maintenance cost acquisition unit 109 in the third embodiment may acquire coating repair cost for suppressing fouling as the maintenance cost. In general, the wall surface of the flow path of the compressor 3 may be coated with PTFE or electroless nickel to suppress the fouling. The coating is partly eroded away when the fouling is removed by applying oil, and thus a repair thereof is required. Therefore, it is possible to easily acquire the more optimal cleaning time Tt and cleaning cycle time Tc in consideration of the maintenance cost including the coating repair by acquiring the coating repair cost with the maintenance cost acquisition unit 109.

The coating repair cost can be calculated, for example, on the basis of a degree of erosion (a damage level) of the coating estimated from oil supply history information (a cumulative time, the cumulative number of times, and the like). Further, the maintenance cost acquisition unit 109 may be configured to send the history information and the degree of erosion of the coating to the display unit 100 for display.

APPENDIX

The compressor system 1 described in the embodiment is understood as follows, for example.

(1) A compressor system 1 according to a first aspect includes a compressor 3 that compresses gas supplied to a flow path formed therein, a water supply unit 4 that supplies water to the flow path inside the compressor 3 in operation, an oil supply unit 5 that supplies oil to the flow path inside the compressor 3 to which the water is supplied, a supply control unit 9 that controls a state of supply of the water to the compressor 3 in the water supply unit 4 and a state of supply of the oil to the compressor 3 in the oil supply unit 5, and an oil information acquisition unit 7 that acquires information on the status of supply of the oil supplied from the oil supply unit 5 to the compressor 3, wherein the supply control unit 9 includes a cleaning instruction unit 91 that sends an instruction to the water supply unit 4 to supply the water to the compressor 3 and sends an instruction to the oil supply unit 5 to supply the oil to the compressor 3 under a cleaning condition having a set cleaning time Tt and cleaning cycle time Tc, a provisional cleaning instruction unit 92 that sends an instruction to the oil supply unit 5 to supply the oil to the compressor 3 under a plurality of provisional cleaning conditions having different predetermined cleaning times Tt and cleaning cycle times Tc, a rate-of-change acquisition unit 93 that acquires a rate of change in efficiency of the compressor 3 from information on a status of operation of the compressor 3, a supply amount acquisition unit 94 that acquires the amount of supply of the oil from the information on the status of supply of the oil acquired by the oil information acquisition unit 7, an operation cost acquisition unit 95 that acquires an operation cost in the cleaning cycle time Tc from the rate of change acquired by the rate-of-change acquisition unit 93, an oil cost acquisition unit 96 that acquires an oil cost for the cleaning time Tt from the amount of supply of the oil acquired by the supply amount acquisition unit 94, and a cost relationship acquisition unit 97 that acquires a plurality of provisional relationship values which is a relationship between the operation cost and the oil cost under each of the plurality of provisional cleaning conditions from the operation cost acquired by the operation cost acquisition unit 95 and the oil cost acquired by the oil cost acquisition unit 96.

In the compressor system 1, the provisional relationship values that are the relationship between the operation cost and the oil cost under each of the plurality of provisional cleaning conditions having different predetermined cleaning times Tt and cleaning cycle times Tc are acquired by the cost relationship acquisition unit 97. As a result, it is possible to grasp the relationship between the operation cost and the oil cost under a plurality of conditions in which the cleaning time Tt for supplying the oil and the cleaning cycle time Tc which is an interval until the next supply of the oil are changed. Therefore, it is possible to grasp how the relationship between the operation cost and the oil cost fluctuates due to the change in the cleaning time Tt and the cleaning cycle time Tc. Thus, it is possible to easily acquire the optimal cleaning time Tt and cleaning cycle time Tc for achieving the desired optimal conditions for the operation cost and oil cost when the inside of the compressor 3 is cleaned with oil.

(2) As the compressor system 1 of (1), a compressor system 1 according to a second aspect further includes a display unit 100 that displays the provisional relationship values acquired by the cost relationship acquisition unit 97.

Thus, the operator can easily grasp the information on the provisional relationship value and can confirm the validity thereof.

(3) As the compressor system 1 of (1) or (2), a compressor system 1 according to a third aspect further includes a remote control unit 101 capable of changing the cleaning time Tt and the cleaning cycle time Tc by sending an instruction to the cleaning instruction unit 91 from a remote location.

Thus, a timing of supplying the oil by the oil supply unit 5 can be easily adjusted from a position distant from the oil supply unit 5 and the cleaning instruction unit 91.

(4) In a compressor system 1 according to a fourth aspect, as the compressor system 1 of any one of (1) to (3), the supply control unit 9 includes a determination unit 98 that determines whether or not any one of the plurality of provisional relationship values acquired by the cost relationship acquisition unit 97 satisfies an optimal reference value predetermined when the compressor 3 is operated, and a cleaning condition setting unit 99 that acquires the cleaning time Tt and the cleaning cycle time Tc corresponding to the provisional relationship value that satisfies the optimal reference value as a regular cleaning condition, and sends an instruction to set the regular cleaning condition to the cleaning instruction unit 91 when any one of the provisional relationship values satisfies the optimal reference value in the determination unit 98.

Thus, the optimal cleaning time Tt and cleaning cycle time Tc when the inside of the compressor 3 is cleaned with oil can be automatically instructed to the oil supply unit 5. Therefore, it is possible to automatically perform the oil injection at the optimal cleaning time Tt and cleaning cycle time Tc without the intervention of the operator.

(5) In a compressor system 1 according to a fifth aspect, as the compressor system 1 of (4), the determination unit 98 sends an instruction to the provisional cleaning instruction unit 92 to set a new provisional cleaning condition having the cleaning time Tt and the cleaning cycle time Tc different from those of the plurality of provisional cleaning conditions when all of the provisional relationship values do not satisfy the optimal reference value, the provisional cleaning instruction unit 92 sends an instruction to the oil supply unit 5 to supply the oil to the compressor 3 under the new provisional cleaning condition, the cost relationship acquisition unit 97 acquires a reacquisition relationship value that is a relationship between the operation cost and the oil cost under the new provisional cleaning condition, the determination unit 98 determines whether or not the reacquisition relationship value acquired by the cost relationship acquisition unit 97 satisfies the optimal reference value, and the cleaning condition setting unit 99 acquires the regular cleaning condition on the basis of the reacquisition relationship value and sends an instruction to the cleaning instruction unit 91 to set the conditions when the reacquisition relationship value satisfies the optimal reference value in the determination unit 98.

Thus, even when there is no optimal cleaning time Tt and cleaning cycle time Tc among the plurality of preset provisional cleaning conditions, the optimal cleaning time Tt and cleaning cycle time Tc can be automatically searched for and acquired. As a result, the optimal cleaning time Tt and cleaning cycle time Tc when the inside of the compressor 3 is cleaned with oil can be easily acquired with high accuracy.

(6) In a compressor system 1 according to a sixth aspect, as the compressor system 1 of (4) or (5), in the determination unit 98, the optimal reference value is an upper limit value of at least one of the operation cost and the oil cost allowable when the compressor 3 is operated.

Thus, at least one of the operation cost and the oil cost when the inside of the compressor 3 is cleaned with oil can be kept within an allowable range for the compressor system 1.

(7) In a compressor system 1 according to a seventh aspect, as the compressor system 1 of any one of (4) to (6), the supply control unit 9 further includes an elapsed rate-of-change acquisition unit 105 that acquires an elapsed rate of change which is the rate of change in efficiency of the compressor 3 per predetermined time in a state in which the oil is not supplied on the basis of the information on the status of operation of the compressor 3, a rate-of-change determination unit 106 that determines whether or not the elapsed rate of change acquired by the elapsed rate-of-change acquisition unit 105 exceeds a predetermined reference rate of change, and an additional cleaning instruction unit 107 that sends an instruction to the oil supply unit 5 to supply the oil to the compressor 3 when the rate-of-change determination unit 106 determines that the elapsed rate of change exceeds the reference rate of change.

Thus, after the oil is supplied, the additional cleaning instruction unit 107 opens the oil supply adjustment valve 53 for the short-term cleaning time Ta, and the oil is supplied to the compressor 3 for a short time before the regular supply. As a result, fouling can be removed at a stage when the efficiency is remarkably lowered in a state in which oil is not supplied according to the regular cleaning conditions. Therefore, efficient fouling removal can be performed with a minimum amount of supply of the oil.

(8) As the compressor system 1 of any one of (1) to (7), a compressor system 1 according to an eighth aspect further includes a compressor information acquisition unit 6 that acquires the information on the status of operation of the compressor 3, and the rate-of-change acquisition unit 93 acquires the rate of change in the efficiency of the compressor 3 in operation on the basis of the information on the status of operation of the compressor 3 acquired by the compressor information acquisition unit 6.

Thus, information for accurately grasping the state of the compressor 3 that is actually in operation can be acquired. Thus, the operation cost when the inside of the compressor 3 is cleaned with oil can be acquired with high accuracy.

(9) In a compressor system 1 according to a ninth aspect, as the compressor system 1 of any one of (1) to (8), the supply control unit 9 further includes a maintenance cost acquisition unit 109 that acquires a maintenance cost when maintenance on the compressor 3 is performed from the information on the state of operation of the compressor 3, and the cost relationship acquisition unit 97 further acquires a relationship between the maintenance cost acquired by the maintenance cost acquisition unit 109, the operation cost, and the oil cost.

Thus, the operation cost and the oil cost when the inside of the compressor 3 is cleaned with oil can be set to the desired optimal conditions in consideration of the maintenance cost. Therefore, more optimal cleaning time Tt and cleaning cycle time Tc can be easily acquired.

(10) In a compressor system 1 according to a tenth aspect, as the compressor system 1 of any one of (1) to (9), the rate-of-change acquisition unit 93 acquires the rate-of-change in the efficiency of the compressor 3 estimated on the basis of a deterioration model of the compressor 3 acquired by modeling the efficiency of the compressor 3 over time.

Thus, the rate-of-change of the efficiency of the compressor 3 can be acquired without providing a device for acquiring information on the compressor 3 in operation. As a result, the cost of the compressor system 1 can be reduced.

EXPLANATION OF REFERENCES

1, 1A, 1B Compressor system
2 Driving machine
O Axis
21 Driving shaft
3 Compressor
31 Rotary shaft
32 Supply line
33 Discharge line
4 Water supply unit
41 Cooling water supply source
42 Cooling water supply line
43 Cooling water supply adjustment valve
5 Oil supply unit
51 Oil supply source
52 Oil supply line
53 Oil supply adjustment valve
6 Compressor information acquisition unit
7 Oil information acquisition unit
8 Cooling water information acquisition unit
9, 9A, 9B Supply control unit
901 Injection system control unit

902 Compressor operation data monitoring unit
903 Remote monitoring unit
91 Cleaning instruction unit
92 Provisional cleaning instruction unit
93 Rate-of-change acquisition unit
94 Supply amount acquisition unit
95 Operation cost acquisition unit
96 Oil cost acquisition unit
97, 97B Cost relationship acquisition unit
98 Determination unit
99 Cleaning condition setting unit
100 Display unit
101 Remote control unit
950 Computer
951 Processor
952 Main memory
953 Storage
954 Interface
Tt Cleaning time
Tc Cleaning cycle time
105 Elapsed rate-of-change acquisition unit
106 Rate-of-change determination unit
107 Additional cleaning instruction unit
109 Maintenance cost acquisition unit

What is claimed is:

1. A compressor system comprising:

a compressor configured to compress gas supplied to a flow path formed therein;

a water supply unit configured to supply water to the flow path inside the compressor in operation;

an oil supply unit configured to supply oil to the flow path inside the compressor to which the water is supplied;

a computer configured to control a state of supply of the water to the compressor in the water supply unit and a state of supply of the oil to the compressor in the oil supply unit; and sensors configured to acquire information on a status of supply of the oil supplied from the oil supply unit to the compressor, wherein the computer:

sends an instruction to the water supply unit to supply the water to the compressor and sends an instruction to the oil supply unit to supply the oil to the compressor under a cleaning condition having a set cleaning time and a cleaning cycle time;

sends an instruction to the oil supply unit to supply the oil to the compressor under provisional cleaning conditions having different predetermined cleaning times and cleaning cycle times;

acquires a rate of change in efficiency of the compressor from information on a status of operation of the compressor;

acquires an amount of supply of the oil from the information on the status of supply of the oil acquired by the sensors;

acquires an operation cost in the cleaning cycle time from the rate of change;

acquires an oil cost for the cleaning time from the amount of supply of the oil; and acquires provisional relationship values which is a relationship between the operation cost and the oil cost under each of the provisional cleaning conditions from the operation cost and the oil cost.

2. The compressor system according to claim 1, further comprising a display unit configured to display the provisional relationship values.

3. The compressor system according to claim 1, further comprising a computer interface configured to change the cleaning time and the cleaning cycle time by sending an instruction to the computer from a remote location.

4. The compressor system according to claim 1, wherein the computer further:

determines whether or not any one of the provisional relationship values satisfies an optimal reference value predetermined when the compressor is operated; and acquires the cleaning time and the cleaning cycle time corresponding to the provisional relationship value that satisfies being the optimal reference value as a regular cleaning condition, and sends an instruction to set the regular cleaning condition to the computer when any one of the provisional relationship values satisfies the optimal reference value.

5. The compressor system according to claim 4, wherein: the computer further:

sets a new provisional cleaning condition having the cleaning time and the cleaning cycle time different from those of the provisional cleaning conditions when all of the provisional relationship values do not satisfy the optimal reference value;

sends an instruction to the oil supply unit to supply the oil to the compressor under the new provisional cleaning condition;

acquires a reacquisition relationship value that is a relationship between the operation cost and the oil cost under the new provisional cleaning condition;

determines whether or not the reacquisition relationship value satisfies the optimal reference value; and acquires the regular cleaning condition based on the reacquisition relationship value and sets the conditions when the reacquisition relationship value satisfies the optimal reference value.

6. The compressor system according to claim 4, wherein the optimal reference value is an upper limit value of at least one of the operation cost and the oil cost allowable when the compressor is operated.

7. The compressor system according to claim 4, wherein the computer further:

acquires an elapsed rate of change which is the rate of change in efficiency of the compressor per predetermined time in a state in which the oil is not being supplied based on the information on the status of operation of the compressor;

determines whether or not the elapsed rate of change exceeds a predetermined reference rate of change; and sends an instruction to the oil supply unit to supply the oil to the compressor when determining that the elapsed rate of change exceeds the reference rate of change.

8. The compressor system according to claim 1, further comprising:

sensors configured to acquire the information on the status of operation of the compressor, wherein the computer acquires the rate of change in the efficiency of the compressor in operation based on the information on the status of operation of the compressor acquired by the sensors.

9. The compressor system according to claim 1, wherein the computer further:

acquires a maintenance cost when maintenance on the compressor is performed from the information on the state of operation of the compressor, and acquires a relationship between the maintenance cost, the operation cost, and the oil cost.

10. The compressor system according to claim 1, wherein the computer acquires the rate-of-change in the efficiency of the compressor estimated based on a deterioration model of the compressor acquired by modeling the efficiency of the compressor over time.

* * * * *